US006095039A

United States Patent [19]

Brendel et al.

[11] Patent Number: 6,095,039

[45] Date of Patent: Aug. 1, 2000

[54] APPARATUS FOR TREATING A PRODUCT WEB

[75] Inventors: Bernhard Brendel; Peter Svenka, both of Grefrath, Germany

[73] Assignee: Kusters Maschinenfabrik GmbH & Co. KG, Germany

[21] Appl. No.: 09/117,753

[22] PCT Filed: Nov. 20, 1997

[86] PCT No.: PCT/EP97/06474

§ 371 Date: Mar. 22, 1999

§ 102(e) Date: Mar. 22, 1999

[87] PCT Pub. No.: WO98/24969

PCT Pub. Date: Jun. 11, 1998

[30] Foreign Application Priority Data

Dec. 6, 1996 [DE] Germany ..... 196 50 576

[51] Int. Cl.[7] ..... D21G 1/00; B30B 3/04

[52] U.S. Cl. ..... 100/47; 100/162 B; 100/172

[58] Field of Search ..... 100/47, 161, 162 R, 100/162 B, 163 R, 163 A, 172

[56] References Cited

U.S. PATENT DOCUMENTS

| | | | |
|---|---|---|---|
| 1,793,114 | 2/1931 | Minton | 100/163 A |
| 3,044,392 | 7/1962 | Minarik | 100/172 |
| 3,172,313 | 3/1965 | Fox | 100/172 |
| 4,471,690 | 9/1984 | Yamaguchi et al. | 100/162 R |
| 5,784,955 | 7/1998 | Conrad | 100/172 |

FOREIGN PATENT DOCUMENTS

| | | | |
|---|---|---|---|
| 2169978 | 9/1996 | Canada . | |
| 2188607 | 5/1997 | Canada . | |
| 29504034 U | 6/1995 | Germany . | |
| 29518424 U1 | 4/1996 | Germany . | |
| 4-185790 | 7/1992 | Japan | 100/161 |

*Primary Examiner*—Stephen F. Gerrity

*Attorney, Agent, or Firm*—Townsend and Townsend and Crew LLP

[57] ABSTRACT

The calender disclosed comprises a vertical stack of linked rolls, which are driven individually by controlled electric motors. The control acts on the distribution of the supplied power to the individual rolls in such a way that the forces which act on the rolls in the horizontal direction, and are measured in the roll bearings, are minimized. This allows the use of slimmer rolls.

15 Claims, 3 Drawing Sheets

APPARATUS FOR TREATING A PRODUCT WEB

BACKGROUND OF THE INVENTION

The invention relates to a calender for treating a product web, in particular a paper web, for example a smoothing calender.

A calender of this type is disclosed, for example, by DE-U-295 04 034. In this calender, an intermediate roll in the roll stack is usually driven and drives the other rolls along by means of friction with the product web. In the document cited, it is specified that the normally passively driven rolls are driven actively in order to thread the product web into the nips. This auxiliary drive needs to be designed only for the idling power until the operating speed is reached, whereas the main drive has to be designed for total power output during operation.

Forces that are fed in from the outside act on the rolls in the vertical direction, as does the weight, increasing from top to bottom, of the rolls mounted above. Deformations that are caused by this—in particular deflection—can be compensated for by means of the deflection controlled rolls. However, forces act on the rolls in the horizontal direction as well. These forces can be attributed to the friction-induced torque transmission mentioned, as is explained in the publication Pav/Svenka, "Der Kompaktkalander—die Antwort auf die Herausforderung nach hohen Geschwindigkeiten bei der Glättung und Satinage" [The compact calender—the answer to the challenge of higher speeds in smoothing and calendering], DAS PAPIER 1985, pp. V178 ff. In this publication, mention is also made of a compact calender, in which four resilient rolls with their own drives form nips around a hard base roll that is mounted in a stationary manner. This is intended to dispense with the interlinking of the roll set, as is unavoidable in the case of calenders of this type.

Whereas vertical deformations of the rolls, as explained above, can be compensated for, this does not apply to deformations resulting from horizontally acting forces. This means that the rolls must have minimum diameters in order that horizontal deformations can be kept within tolerable limits. One of these limitations resides in the fact that, in the event of a deformation of a roll in the horizontal direction, the distribution of the line load becomes non-uniform, the regions close to the bearings being loaded more severely. This can lead to over-pressing of the product web in the edge region and to the unequal distribution of the product-web property values in the cross-machine profile. Furthermore, increased wear of the resilient roll covers and, in the extreme case, destruction of the same can occur. At a given line load, the compressive stress is limited by the minimum diameters of the rolls to an appropriate value, which may be increased only by increasing the line load. However, even if the horizontal deformation of the rolls is kept within limits, shear stresses nevertheless act on the product web in the nip and—in the case of paper—can loosen the bonding between the fibres in the web running direction and thereby reduce the strength of the paper.

The object of the invention is to specify a calender in which the compressive stress can be increased at a given line load by the roll diameters being reduced.

Since the roll diameters no longer need to be designed in accordance with the horizontally acting forces, because the effects of the latter are controlled out, it is possible to design the rolls with diameters which are determined by criteria other than the resistance to deflection or the horizontal deformations, for example by the critical inherent frequencies.

Rolls of a smaller diameter have a lower weight, so that the static (gravitation-induced) forces are lower in relative terms and smaller bearings can also be used.

The drives apply the specific power for the respectively driven roll, this power being composed of re-forming, transporting and loss power. In this case, a distribution of 50:50 to the two nip-forming rolls would be only a rough guide, since, for example, a deflection controlled roll has considerably higher friction losses than a normal solid roll.

The forces which are to be controlled out according to the invention can be measured, for example, in the roll bearings; bearings with force-measuring systems incorporated are commercially available. However, it is at least also conceivable to use measurement methods to register the horizontal deformations that are brought about by such forces.

An exemplary embodiment of a calender according to the invention is illustrated in the appended drawings and will be explained below in detail.

DETAILED DESCRIPTION OF THE INVENTION

Figure 1:
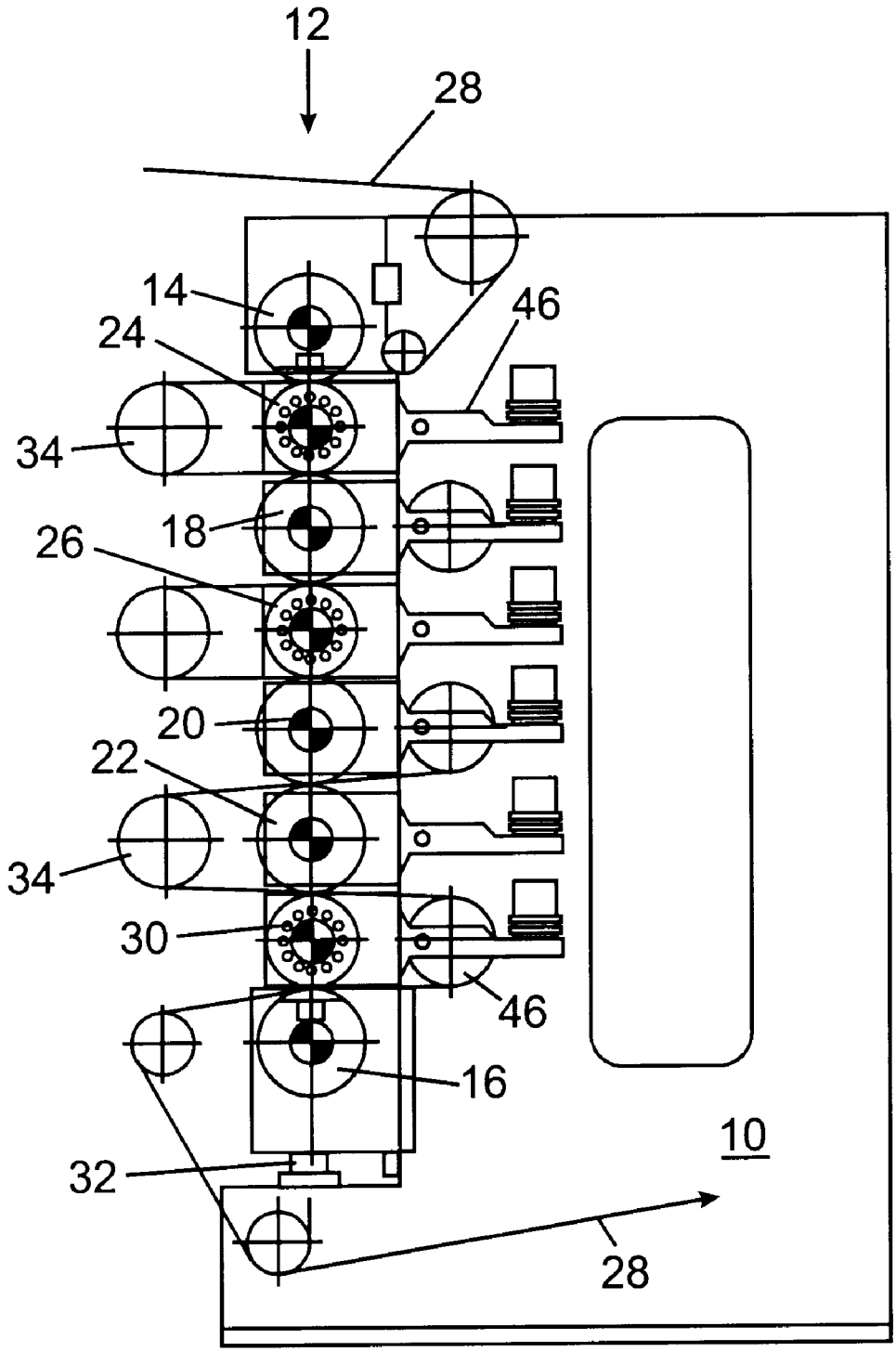
FIG. 1 is a largely schematic side view of a calender according to the invention.

A calender frame 10 with side uprights is designed as a welded or cast construction. Arranged in the frame 10 is a calender 12, which has eight nip-forming rolls. The top and the bottom rolls 14 and 16, respectively, are deflection controlled rolls, and the yoke of the upper deflection controlled roll is clamped immovably in the frame; the bearings of this roll are also immovable. The roll 14 is provided with a resilient cover, as are the lower deflection controlled roll 16 and the rolls 18, 20 and 22, which are provided in the calender 12. Arranged between the rolls 14 and 18 is a hard, heatable roll 24, which forms a nip in each case with the rolls 14 and 18 respectively arranged above and below it. In addition, between the rolls 18 and 20 there is a hard, heatable roll 26, which defines a nip with each of these rolls. The nip through which the product web 28 passes between the rolls 20 and 22 is used not only for re-forming the product web but also as a reversing nip, in order to turn that side of the product web that previously faced the resilient rolls towards the hard, heatable roll 30, which is arranged between the rolls 22 and 16. (The relevant side of the product web has already passed through four nips albeit facing a resilient roll in each case, but has nevertheless been smoothed to such an extent in the process that passage through two further nips on the heated side is sufficient).

The bearings of all the rolls, with the exception of the upper deflection controlled roll 14, are arranged in the frame 10 such that they can be displaced by sliding. The loading of the nips is carried out by means of hydraulic cylinders 32 and results, for example, in an average line force of 500 N/mm. It should be noted that the line force can also be applied by means of the deflection controlled rolls. The hard rolls may be heated with steam to, for example, up to 200° C. The resilient rolls may be temperature-controlled. The product web 28 is led between the individual nips around guide rolls 34, whose surfaces are provided with spiral grooves in order to ensure that the product web is kept spread out and to prevent the formation of an air cushion on which the product web could float. Pneumatic compensation of the overhanging loads is carried out by means of compensation units 46, in whose stead hydraulic or other servo drives may also be provided.

Normal spreader rolls may also be provided. The calender arrangement shown can be arranged downstream of a paper or coating machine as an "in-line calender", or can operate as an "off-line calender".

The arrangement described thus far largely corresponds to the prior art, apart from the fact that the diameter of the rolls between the deflection controlled rolls, but at least of the hard rolls, is considerably smaller than usual.

According to the first variant of the invention, each nip-forming roll is provided with its own drive, comprising an electric motor, for example a DC motor, which is coupled via a cardan-shaft to the roll assigned to it and which is fed from a regulated supply unit. In FIG. 1, the drives are indicated only by the usual two-quadrant circle symbol.

Figure 4:
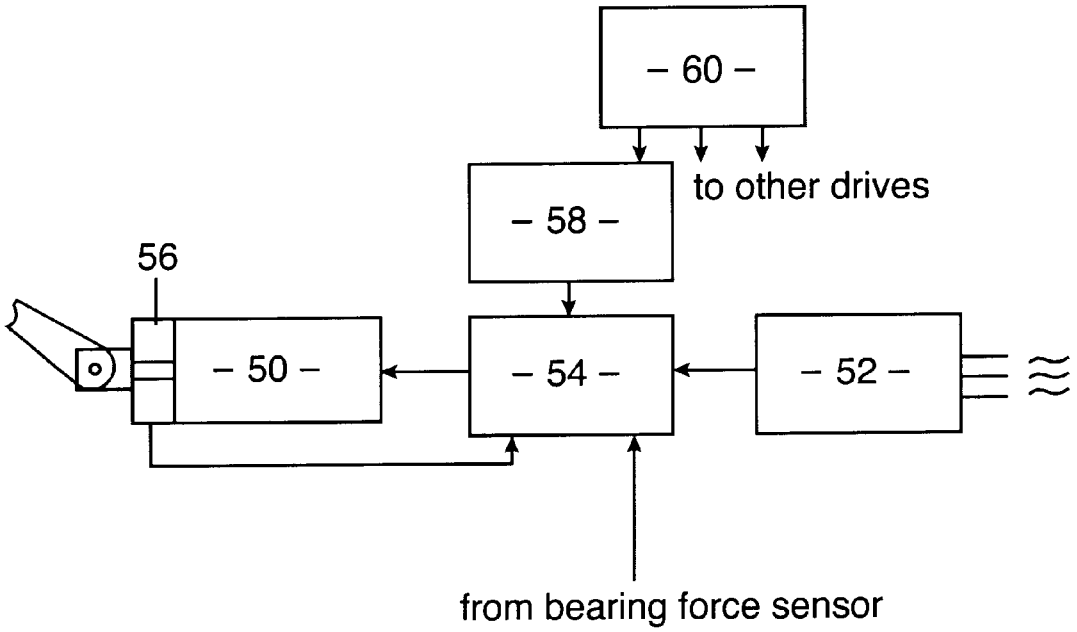
FIG. 4 is a block diagram of the control of one of the rolls.

FIG. 4 shows the drive to one of the rolls. The drive motor is a DC motor 50, fed from a converter 52 via a controller 54, preferably a digital PID controller.

In the start-up phase, the rotational speed is controlled; for this, each motor 50 has an actual-value transmitter in the form, for example, of a tachogenerator 56; the set points can be stored in an electronic memory 58, which is read out sequentially. In the start-up phase, the set points are selected such that the rolls which in each case define a nip have the same circumferential speed.

In the operating phase, the circumferential speed is a suitable parameter only to a limited extent, since the resilient rolls certainly deform in the region of the nip, that is to say there is no longer strict proportionality between rotational speed and circumferential speed. This is correspondingly true for the expansion which occurs when a roll is heated.

For this reason, power control is carried out during operation. Each roll is supplied with an amount of power which, at least approximately, covers half the re-forming and transporting power transmitted to the product web in each nip defined by the said roll, plus the loss power. It should be noted that the drive power of the guide rolls 44 in the embodiment illustrated is transmitted by means of the product web in the manner of a flexible gear mechanism; this power therefore also has to be taken into account when calculating the set points—also stored in the memory 56. However, it is preferred, particularly in the case of larger in-line calenders, to provide the guide rolls with their own drives as well.

The power control arrangement has the special feature that, when metering the power to the motors, which each drive pairs of rolls which bound a nip, the power of both motors is adjusted in the event of a set-point deviation and, since all the rolls are linked to one another, this means a control intervention in all the motors. An overall controller 60 is therefore placed hierarchically above the individual motor controller and in the event of a set-point deviation, even just in the case of a single roll, calculates new set points for the power for all the rolls or takes these set points from a look-up table memory.

Arranged in the bearings of the rolls are force sensors, which sense at least the forces that are transmitted in the horizontal direction from the relevant roll to the frame 10. Such "force-measuring bearings" are offered, for example, by SKF Kugellagerfabriken GmbH, Schweinfurt. As mentioned above, the power or, more precisely, the power distribution is controlled in such a way that these horizontal forces are kept as small as possible.

The calender arrangement according to FIG. 1 can be operated in such a way that the number of nips through which the web passes is predefined; furthermore, the operator is able to influence the technological result by selecting the line load and the roll temperatures.

Figure 2:
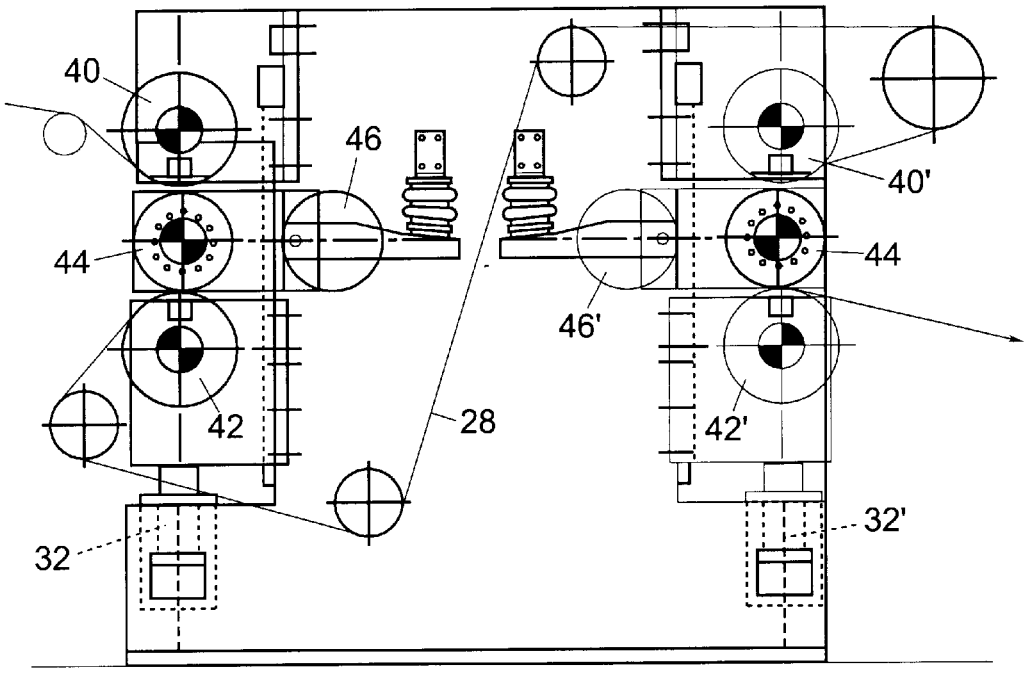
FIG. 2 shows a second embodiment in a similar illustration.

FIG. 2 shows, as a second embodiment, a double calender having in each case only two nips for calendering one of the product web sides in each case. The elements of the calender on the left in the drawing are designated using the reference symbols of analogous elements in FIG. 1; in the case of the right-hand calender, an index stroke "'" is added in each case. It can be seen that each individual calender also has just two deflection controlled rolls 40 and 42 with a resilient cover, and a hard, heated roll 44 arranged between them.

Figure 3:
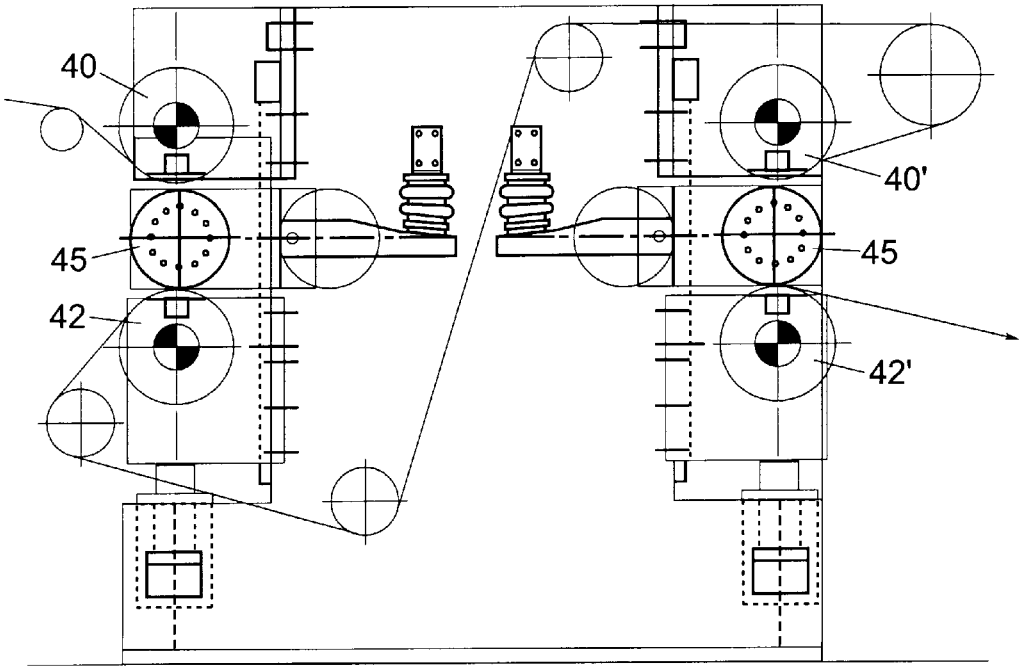
FIG. 3 shows a modification of the second embodiment.

FIG. 3 illustrates an example of the second variant of the invention, derived from the embodiment according to FIG. 2. Here, the hard, heated, intermediate roll 45 does not have its own drive, but rather is driven along by the covers of the deflection controlled rolls 40, 42. Although the latter transmit the drive torques through the product web to the hard roll 46, the drives of the two resilient rolls are controlled in such a way that the forces acting on the hard roll are equal and opposite.

It is assumed that, for example in the case of smoothing calenders, the extremely high compressive a stresses in the nips, in combination with high temperature, mean that good technological results can be achieved with the configurations illustrated in FIGS. 2 and 3. In addition to such a 3/3 configuration, numerous further configurations in which in each case a hard roll is arranged between two resilient rolls, such as the configurations 5/3, 7/3, 5/5, 8/5 and so on, are conceivable.

What is claimed is:

1. Calender (12) for treating a product web (28), comprising a plurality of rolls (14 to 26, 30), of which in each case a hard roll and a resilient roll define a nip, which rolls are fitted in uprights of a frame (10) with their axes vertically displaceable, and the bottom roll and the top roll being deflection controlled rolls (16/26, 18/30), characterized in that the rolls of a pair of rolls which form at least one nip are in each case assigned their own drive (50, 52, 54, 56, 58, 60), which is controlled in such a way that forces acting on the rolls in the horizontal direction are kept to a minimum and in that the drives of the individual rolls are supplied in a controlled manner with the power that is needed for the losses of the relevant roll and with at least approximately half the power for re-forming the product web and for transporting the product web.

2. Calendar for treating a product web, comprising a plurality of rolls, of which in each case a hard roll and a resilient roll define a nip, which rolls are fitted in uprights of a frame with their axes vertically displaceable, and the bottom roll and the top roll being deflection controlled rolls, characterized in that the upper and lower resilient rolls of a group which comprises three rolls and defines two nips are in each case assigned their own drive, which is controlled in such a way that forces acting on the rolls in the horizontal direction are kept to a minimum and in that the drives of the individual rolls are supplied in a controlled manner with the power that is needed for the losses of the relevant roll and with at least approximately half the power for re-forming the product web and for transporting the product web.

3. Calender according to claim 1 or 2, characterized in that the actual horizontal forces occurring in the roll bearings are measured.

4. Calender according to claim 1 or 2, characterized in that all the rolls which bound a nip are equipped with their own drives.

5. Calender according to claim 1 or 2, characterized in that the resilient rolls comprise a core provided with a resilient plastic cover.

6. Calender according to claim 1 or 2, characterized in that a yoke which absorbs deflection forces and belongs to at least one of the deflection controlled rolls (14, 16) is arranged immovably in uprights of the frame (10).

7. Calender according to claim 1 or 2, characterized in that each drive is assigned a controller (54), which, in the event of a set-point deviation, is supplied with an adapted set point by a higher-order overall controller (60).

8. Calender according to claim 7, characterized in that the individual controllers and the overall controller are designed to control the power distribution to all the drives.

9. Calender (12) for treating a product web (28), comprising a plurality of rolls (14 to 26, 30), of which in each case a hard roll and a resilient roll define a nip, which rolls are fitted in uprights of a frame (10) with their axes vertically displaceable, and the bottom roll and the top roll being deflection controlled rolls (16/26, 18/30), characterized in that the rolls of a pair of rolls which form at least one nip are in each case assigned their own drive (50, 52, 54, 56, 58, 60), which is controlled in such a way that forces acting on the rolls in the horizontal direction are kept to a minimum and in that each drive is assigned a controller (54), which, in the event of a set-point deviation, is supplied with an adapted set point by a higher-order overall controller (60).

10. Calender for treating a product web, comprising a plurality of rolls, of which in each case a hard roll and a resilient roll define a nip, which rolls are fitted in uprights of a frame with their axes vertically displaceable, and the bottom roll and the top roll being deflection controlled rolls, characterized in that the upper and lower resilient rolls of a group which comprises three rolls and defines two nips are in each case assigned their own drive, which is controlled in such a way that forces acting on the rolls in the horizontal direction are kept to a minimum and in that each drive is assigned a controller (54), which, in the event of a set-point deviation, is supplied with an adapted set point by a higher-order overall controller (60).

11. Calender according to claim 9 or 10, characterized in that the actual horizontal forces occurring in the roll bearings are measured.

12. Calender according to claim 9 or 10, characterized in that all the rolls which bound a nip are equipped with their own drives.

13. Calender according to claim 9 or 10, characterized in that the resilient rolls comprise a core provided with a resilient plastic cover.

14. Calender according to claim 9 or 10, characterized in that a yoke which absorbs deflection forces and belongs to at least one of the deflection controlled rolls (14, 16) is arranged immovably in uprights of the frame (10).

15. Calender according to claim 9 or 10, characterized in that the individual controllers and the overall controller are designed to control the power distribution to all the drives.

* * * * *